US005287700A

United States Patent [19]

Hein et al.

[11] Patent Number: 5,287,700

[45] Date of Patent: Feb. 22, 1994

[54] FLEXIBLE BELLOWS ACTUATION SYSTEM

[75] Inventors: Jeffrey M. Hein, Fountain Hills; Richard Piechowicz, Scottsdale, both of Ariz.

[73] Assignee: McDonnell Douglas Helicopter Company, Mesa, Ariz.

[21] Appl. No.: 960,856

[22] Filed: Oct. 14, 1992

[51] Int. Cl.[5] ..... F15B 7/00; F01B 19/00

[52] U.S. Cl. ..... 60/581; 60/582; 60/583; 92/34; 92/38; 92/48

[58] Field of Search ..... 60/546, 561, 567, 581, 60/582, 583, 562, 579, 580, 594; 92/34, 37, 38, 32, 48

[56] References Cited

U.S. PATENT DOCUMENTS

| | | | |
|---|---|---|---|
| 1,986,764 | 1/1935 | Rhodes | 60/580 |
| 2,325,967 | 8/1943 | Moore . | |
| 2,466,415 | 4/1949 | Greenland . | |
| 2,544,785 | 3/1951 | Gardner | 92/37 |
| 2,953,166 | 9/1960 | Carlson, Jr. . | |
| 2,973,748 | 3/1961 | Leland et al. . | |
| 3,024,771 | 3/1962 | Criffield et al. . | |
| 3,055,219 | 9/1962 | Wilson et al. | 92/34 |
| 3,133,476 | 5/1964 | Geyer . | |
| 3,207,468 | 9/1965 | Lauducci et al. . | |
| 3,495,502 | 2/1970 | Bousso . | |
| 3,695,148 | 10/1972 | Baginski et al. . | |
| 4,004,299 | 1/1977 | Runge . | |
| 4,108,050 | 8/1978 | Paynter . | |
| 4,192,222 | 3/1980 | Dits | 92/151 |
| 4,193,337 | 3/1980 | Disdier . | |
| 4,230,025 | 10/1980 | Caliri . | |
| 4,607,998 | 8/1986 | Hawkes | 60/594 |
| 4,655,031 | 4/1987 | Kucera . | |
| 4,711,156 | 12/1987 | Kayyod et al. . | |
| 4,711,157 | 12/1987 | Kayyod et al. . | |
| 4,751,868 | 6/1988 | Paynter . | |

FOREIGN PATENT DOCUMENTS

| | | | |
|---|---|---|---|
| 752390 | 9/1933 | France | 60/581 |
| 860939 | 1/1941 | France | 60/583 |

*Primary Examiner*—Thomas E. Denion

*Attorney, Agent, or Firm*—Donald E. Stout; John P. Scholl

[57] ABSTRACT

A closed loop fully self-contained actuation system for converting a mechanical input motion into a mechanical output motion, which actuates a device such as a flight control surface on an aircraft, comprises an input actuator including a first fluid pressurizing means responsive to the mechanical input motion, and an output actuator including a second fluid pressurizing means, as well as a flexible fluid line extending between the first and second fluid pressurizing means to provide fluid communication therebetween. The second fluid pressurizing means is responsive to fluid flow through the fluid line, thereby initialing the output motion. The system is advantageous because it requires no hydraulic pumps, no accumulators, no reservoirs, and no dynamic seals or mechanical joints, permitting great reliability. The actuation system may be easily folded in conjunction with the apparatus on which it is employed, for compact storage.

11 Claims, 2 Drawing Sheets

FLEXIBLE BELLOWS ACTUATION SYSTEM

The U.S. Government has rights in this invention pursuant to contract number DAAJ09-89-C-A102, awarded by the Department of the Army.

BACKGROUND OF THE INVENTION

This invention relates to an actuation system, and more particularly to a flexible bellows actuation system which is capable of being folded without affecting its integrity or requiring complex dynamic seals and mechanical joints.

Actuation systems are required in many different types of apparatuses, in order to move elements of the apparatus which are more conveniently moved from a remote location than directly. One particular common aerospace application is the actuation of flight surfaces such as flaps or thruster controls. These surfaces are typically on an engine, wing, rotor, or stabilizer, and are not directly accessible to the aircraft pilot, but rather are actuated remotely from the cockpit by use of such an actuation system. Such an actuation system may be mechanical, electrical, or electro-mechanical.

Certain applications, particularly military in nature, sometimes require portions of the aircraft to fold, in order to decrease the overall dimensions of the aircraft for more compact storage. In such applications, the hinge line about which the craft is folded often intersects portions of one or more of the actuation systems, requiring that the actuation system be capable of being folded without affecting its integrity and reliability. Oftentimes, electronic or electromechanical actuators are not desirable because of the risks of jamming and electromagnetic interference (EMI). Weight, complexity, and the lack of available space at the designated break line often eliminates many mechanical candidates. For example, a standard hydraulic actuation system typically employs a ram and piston, both of which require dynamic seals. Such dynamic seals often result in leaks, which in turn cause many actuator failures.

What is needed, therefore, is an actuation system which is mechanical, simple, lightweight, and reliable, yet capable of being folded and unfolded repeatedly without loss of function or reliability.

SUMMARY OF THE INVENTION

This invention solves the problem outlined above by providing a mechanical actuation system which is closed loop and fully self-contained. It requires no hydraulic pumps, no accumulators, and no reservoirs. The device, which employs a plurality of bellows, acts exactly as a master cylinder/slave cylinder system in a car, except that a second set of cylinders (bellows) handles the return motion, whereas a car braking system uses springs. The system operates by simply converting a push/pull mechanical motion into a directional fluid flow, which flows through a flexible line across a hinge and is reconverted into mechanical motion. The bellows actuator's piston mechanism is not in contact with any fluid and therefore does not require sealing. The actuator may have an axial stroke or rotational motion. Only static seals at the bellows/flexible hose interface are required. This design eliminates the dynamic seals, and therefore greatly increases the reliability of the actuation system, because of the reduced risk of leakage.

Now in greater detail, the actuation system, which converts a mechanical input motion into a mechanical output motion, that in turn actuates a device, comprises an input actuator including a first fluid pressurizing means, which is responsive to the mechanical input motion. Further included are an output actuator, including a second fluid pressurizing means, and a flexible fluid line extending between the first and second fluid pressurizing means to provide fluid communication therebetween. The second fluid pressurizing means is responsive to fluid flow through the fluid line, thereby initiating the output motion.

Each of the input and output actuators comprise a housing, an actuator shaft, and a guided piston assembly which interacts with its respective fluid pressurizing means. Both the input and output mechanical motions may be either linear or rotational, with appropriate linear-rotary conversion if necessary, since the guided piston assembly always moves linearly.

The above mentioned and other objects and features of this invention and the manner of attaining them will become apparent, and the invention itself will be best understood, by reference to the following description taken in conjunction with the accompanying illustrative drawings.

DETAILED DESCRIPTION OF THE DRAWINGS

Figure 1:
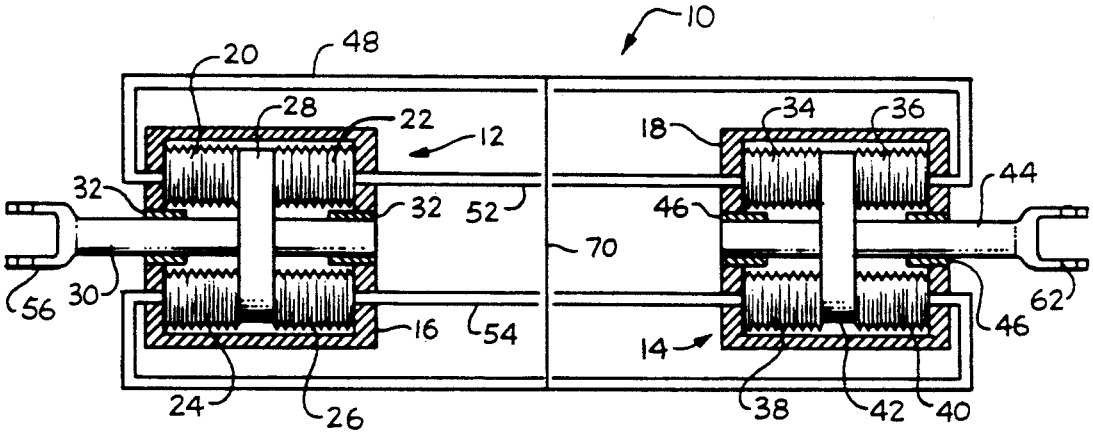
FIG. 1 is a cross-sectional view of a bellows actuation system constructed in accordance with the principles of this invention, which includes both an input actuator and an output actuator.

In FIG. 1, there is illustrated a typical bellows actuation system 10 of the invention, including an input (master) actuator 12 and an output (slave) actuator 14. Each actuator 12, 14 includes a housing 16, 18, respectively. Enclosed within the input actuator housing 16 are four bellows 20, 22, 24, and 26, as well as a guided piston assembly 28, an actuator shaft 30, and shaft support bearings 32. Similarly, four bellows 34, 36, 38, and 40 are enclosed within the output actuator housing 18, along with a guided piston assembly 42, an actuator shaft 44, and shaft support bearings 46. The bellows 24 and 26 in the master housing 16, as well as the bellows 38 and 40 in the slave housing 18 are redundant to the bellows 20, 22 and 34, 36, respectively, for safety reasons to be more fully explained hereinbelow. The actuator housings 12, 14 are vented to permit the escape of fluid in the event of a bellows failure.

Flexible hydraulic fluid line 48 connects input bellows 20 with output bellows 36, as shown in FIG. 1. Similarly, fluid line 50 connects bellows 24 and 40, fluid line 52 connects bellows 22 and 34, and fluid line 54 connects bellows 26 and 38. The fluid connections between bellows 20 and 36 as well as between bellows 22 and 34, together form a closed loop system, which is obtained because the two open looped bellows pairs are positioned on opposite sides of the guided piston assembly 28, 42. A redundant closed loop system is obtained because of the fluid connections between bellows 24 and 40, as well as between bellows 26 and 38. Because of this redundancy, the failure of any one bellows has no impact on the operation of the actuation system.

Figure 2:
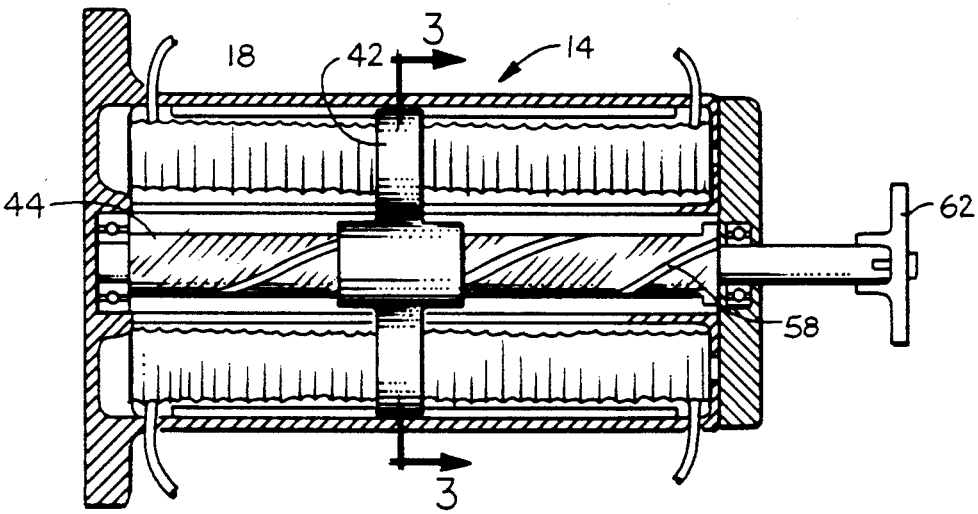
FIG. 2 is a cross-sectional view of the output actuator shown in FIG. 1.

In one preferred embodiment, the input actuator 12 is a linear input actuator. Linear motion is transferred into the actuator 12 from an external source (not shown) by means of a standard mechanical coupling 56 attached to the input shaft 30. The output actuator 14 is preferably a rotary actuator. Viewing FIGS. 2 and 3, in conjunction with FIG. 1, which show greater details of certain features of the output actuator 14, it can be seen that the guided piston 42 is piloted on the output shaft 44. The shaft 44 is provided with an opposed pair of spiral grooves 58, into which a drive connection mechanism 60, mounted on the guided piston 42, is inserted. The spiral grooves 58 are tailored to provide the desired rotational output response, which is transmitted from the actuator 14 to a controlled device (not shown) by means of a mechanical coupling 62 attached to the output shaft 44.

In order to ensure that the drive connection mechanism 60 properly tracks along the spiral grooves 58 as the guided piston 42 travels linearly along the shaft 44, in a manner to be described more fully hereinbelow, it is essential that the piston 42 be restrained from rotation within the housing 18. To ensure this restraint, grooves 62 are machined into both the top and bottom of the fixed housing 18. A restraint element 64 extends from each end of the piston 42 into each respective groove. When the piston 42 is actuated to move linearly along the shaft 44 in response to an input actuation, confinement of the restraint element 64 within the groove 62 will prevent the piston 42 from moving rotationally with respect to the housing 18, though axial movement therealong will not be impeded.

Figure 4:
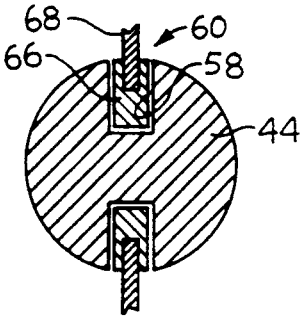
FIG. 4 is a cross-sectional enlarged view of the drive connection shown in FIG. 3, showing further details thereof.
Figure 3:
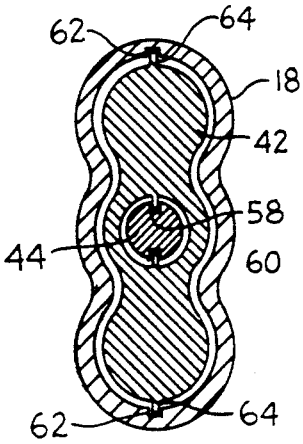
FIG. 3 is a cross-sectional view along lines 3—3 of FIG. 2, showing further details of the drive connection between the guided piston assembly and the output shaft.

A preferred embodiment for the drive connection mechanism 60, shown in FIG. 3, is illustrated in FIG. 4. As shown in the figure, the drive connection mechanism 60 preferably comprises a roller 66, which is positioned to roll along the spiral groove (or track) 58. A guide pin 68 extends from the guided piston assembly 42 and is attached to the roller 66, serving to guide it along the groove 58. In the preferred embodiment, this type of mechanism, including a roller and guide pin, comprises the piston restraint element 64 described above.

Figure 5:
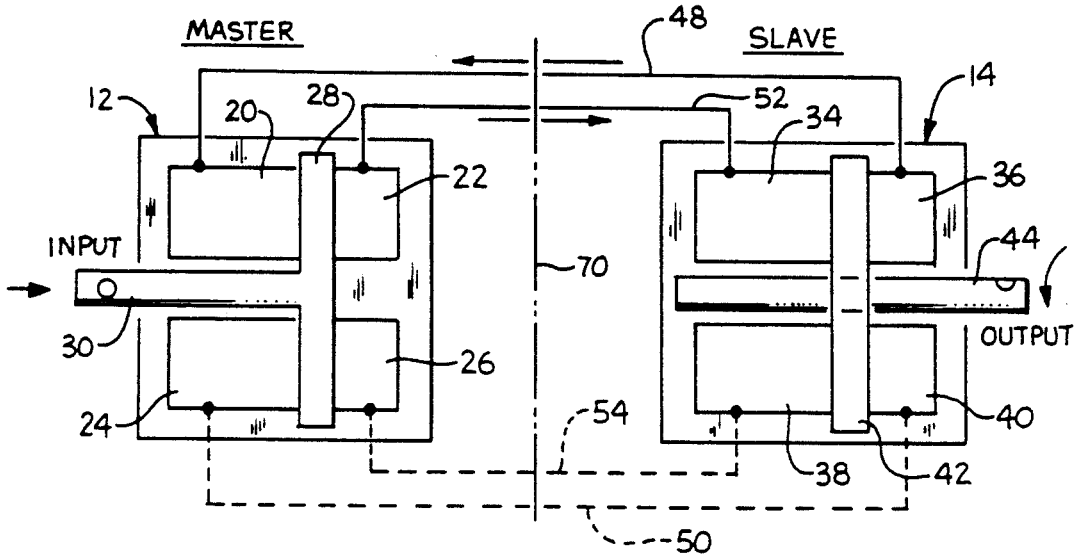
FIG. 5 is a schematic view of the bellows actuation system shown in FIG. 1, showing the fluid flow interconnections between the various bellows in the system, wherein the linear input is a push input.
Figure 6:
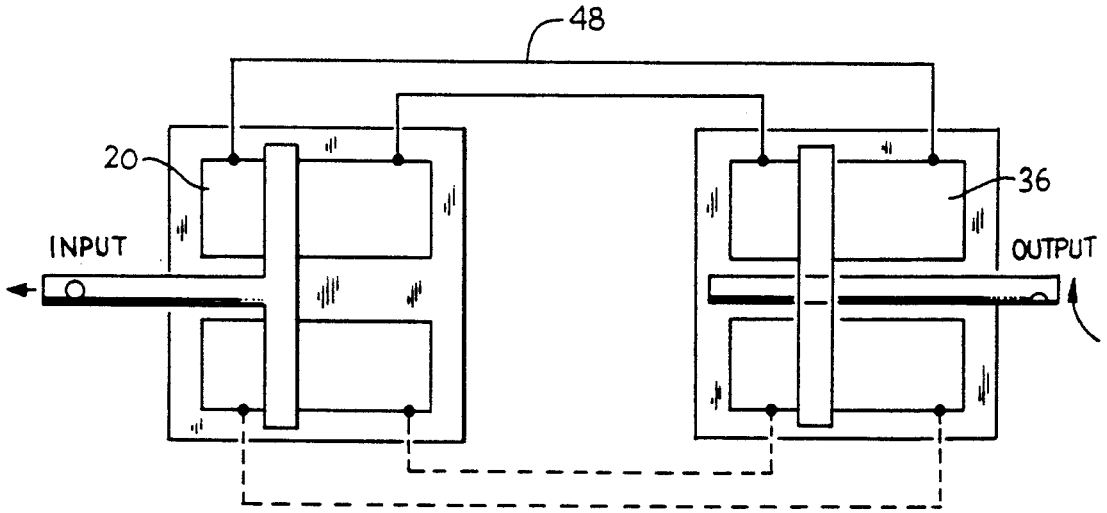
FIG. 6 is a schematic view similar to FIG. 5, wherein the linear input is a pull input.

Operation of the device will now be described, with reference to FIGS. 5 and 6, which are diagrammatic, schematic representations of the FIG. 1 system, shown in operation. FIG. 5 represents the case of a "push" linear input, while FIG. 6 represents a "pull" linear input. Now viewing FIG. 5 in particular, a mechanical input "push" signal, represented by the arrow depicted in the figure, pressurizes the fluid in bellows 22, thereby forcing fluid through the line 52 into bellows 34. The resultant expansion of bellows 34 in turn produces linear movement of the guided piston assembly 42. As described earlier, this linear motion of the piston assembly 42 causes the drive connection mechanism 60 to travel along the spiral grooves 58 on the output shaft 44 (see FIGS. 2 and 3), which results in rotation of the shaft, as shown by the arrow in the figure. Rotational motion is transferred from the actuator to a controlled device by the mechanical coupling 62 (see FIGS. 1 and 2).

It is important to note that as the bellows 34 expands due to the influx of hydraulic fluid from line 52, the bellows 36 compresses correspondingly, thereby forcing fluid through line 48 into the bellows 20. This "closed loop" keeps the actuation forces balanced in the system, eliminating backlash. Only the spring rate in the bellows, viscous losses in the traveling fluid, and bearing friction contribute to additional input loads (system inefficiencies).

Another key feature of the inventive system is the inclusion of a redundant loop, to ensure operability even during failure (burst or leakage) of the primary loop. Thus, in the case of the FIG. 5 example, the linear input motion represented by the arrow also pressurizes the fluid in the bellows 26. This pressurization forces fluid through the line 54 into the bellows 38, causing resultant expansion of the bellows 38, precisely in the same manner by which the bellows 34 is expanded in the first loop. Therefore, should the first loop fail, this redundant loop including the bellows 26, 38, 40, and 24 will transmit the input motion to the output shaft without any interruption or noticeable difference in the operation of the system.

As shown in FIG. 6, a mechanical input "pull" signal, represented by the linear arrow shown in the figure, pressurizes the fluid in bellows 20, thereby forcing fluid through the line 48 into the bellows 36. The resultant expansion of bellows 36 in turn produces linear movement of the guided piston assembly 42, in the opposite direction to that obtained in the FIG. 5 example. This in turn results in rotational motion of the output shaft 44, in the manner described above, and as shown by the arrow. Of course, since the linear movement of the piston assembly 42 is opposite in direction to that obtained in the FIG. 5 example, the direction of the output shaft rotation will also be opposite to that in FIG. 5. A redundant backup loop, involving the bellows 24, 26, 38, and 40, operates in parallel to the primary loop, in a manner similar to that discussed in reference to FIG. 5.

In application, a major advantage of the above described system is in its ability to permit mechanical motion to be transmitted across a flexible joint (or hinge line) 70, without the need for complex mechanical joints and seals. For example, a structure employing the inventive actuation system to control flight control surfaces or the like may be folded along one or more hinge lines 70, which lie between the two input and output actuators 12 and 14, without affecting the operability of the device and without undue complexity or weight in the region of the joint. There are many other advantages. The system is a "bolt-on", self-contained unit requiring no external power source or plumbing. The use of bellows, rather than the more conventional ram and piston in a standard hydraulic system, eliminates the need for dynamic seals and their associated friction, which is the main contributor to leakage and failure in an actuator. There is no need for mechanical stops, locks, or a release system, and the system uses a simple, non-pressurized housing. Furthermore, the actuator, because of its few moving parts, is jam resistant, and the opposing bellows produce a balanced force system that is self centering (fail-safe). Centering will occur (due to the spring rate of the bellows) even in the event of a total system fluid loss without any additional mechanisms.

Although an exemplary embodiment of the invention has been shown and described, many changes, modifications, and substitutions may be made by one having ordinary skill in the art without departing from the spirit and scope of the invention. For example, rather than the above described linear input/rotary output system, the invention applies just as well to linear input/linear output, rotary input/linear output, or rotary input/rotary output systems, since the basic inventive concept is the same in each instance. Additionally, the inventive system may be designed with non symmetrical loading and stroke through the use of constant volume but different stroke/diameter bellows. Alternatively, it may employ variable (nonlinear) rates, torques, and loads through the use of tailored shape bellows or tailored spiral grooves, or a combination of both. By maintaining constant volume but varying bellows area and shape, load, rate, and stroke may be traded off between the master and slave actuators. By tailoring the spiral grooves of the rotary actuator, rotational response may be further varied. Potentially, the system may even combine rotational and axial motion actuators (helical travel) using unrestrained input/output shafts.

Other advantages and system options potentially available include the use of different hydraulic fluids having diverse properties, which permit performance in a variety of temperature and pressure environments. Specific fluid viscosities or metering of the fluid through an orifice will produce predictable damping in the system. A "weak link" producing a predetermined failure to prevent a high load transfer can be included by incorporating rupture disks or the like into the fluid circuit. The direction of output motion may be reversed by exchanging fluid connections of the push-pull bellows at either the input or the output actuator. Finally, plumbing lines may be integrally ported through a mechanical hinge, thereby eliminating a service loop in the hydraulic lines.

Consequently, the scope of the invention is to be limited only in accordance with the following claims:

What is claimed is:

1. An actuation system for converting a mechanical input motion into a mechanical output motion wherein said mechanical output motion actuates a device, said actuation system comprising:

an input actuator including a first fluid pressurizing means, a housing, an input actuator shaft extending into said housing, and a first guided piston assembly connected to said input actuator shaft, said first fluid pressurizing means comprising a first bellows and a second bellows, each having fluid therein and being arranged generally end-to-end, said input actuator shaft being adapted to move in response to said mechanical input motion and said first guided piston assembly being adapted to travel linearly in response to motion of said shaft, a portion of said first guided piston assembly being positioned between said first and second bellows;

an output actuator including a second fluid pressurizing means; and a flexible fluid line extending between said first and second fluid pressurizing means and providing fluid communication therebetween;

wherein the linear travel of said first guided piston assembly compresses one of said two bellows, thereby pressurizing the fluid therein and forcing it through said fluid line into said second fluid pressurizing means, said second fluid pressurizing means being responsive to said pressurized fluid and thereby initiating said mechanical output motion.

2. The actuation system as recited in claim 1, wherein said output actuator comprises:

a housing;

an output actuator shaft extending into said housing; and a second guided piston assembly connected to said output actuator shaft and arranged to interact with said second fluid pressurizing means in such a manner as to travel linearly in response to the influx of said pressurized fluid into said second fluid pressurizing means, wherein said output actuator shaft is adapted to move in response to the linear travel of said second guided piston assembly, thereby actuating said mechanical output motion.

3. The actuation system as recited in claim 2, wherein said second fluid pressurizing means comprises a third bellows and a fourth bellows arranged generally end-to-end, a portion of said second guided piston assembly being positioned between said third and fourth bellows, said pressurized fluid being forced from said fluid line into one of said third and fourth bellows to expand said one of said bellows, the expansion of said one of said bellows actuating said second guided piston assembly to travel linearly, thereby actuating said output actuator shaft.

4. The actuation system as recited in claim 3, wherein a first flexible fluid line interconnects said first bellows and said fourth bellows to form a first open looped bellows pair, and a second flexible fluid line interconnects said second bellows and said third bellows to form a second open looped bellows pair, said second and third bellows both being positioned between said first and second guided piston assemblies, such that the two open looped bellows pairs together constitute a first closed loop system.

5. The actuation system as recited in claim 4, wherein said first fluid pressurizing means further comprises a fifth bellows and a sixth bellows, each having fluid therein and being arranged generally end-to-end, a portion of said first guided piston assembly being positioned between said fifth and sixth bellows such that when said first guided piston assembly is actuated to travel linearly, one of said two bellows is compressed, thereby pressurizing said fluid therein and forcing it into a fluid line.

6. The actuation system as recited in claim 5, wherein said second fluid pressurizing means further comprises a seventh bellows and an eighth bellows arranged generally end-to-end, a portion of said second guided piston assembly being positioned between said seventh and eighth bellows, said pressurized fluid being forced from said fluid line into one of said seventh and eighth bellows to expand said one bellows, the expansion of said one bellows actuating said second guided piston assembly to travel linearly, thereby actuating said output actuator shaft.

7. The actuation system as recited in claim 6 wherein a third flexible fluid line interconnects said fifth bellows and said eighth bellows to form a third open looped bellows pair, and a fourth flexible fluid line interconnects said sixth bellows and said seventh bellows to form a fourth open looped bellows pair, said sixth and seventh bellows both being positioned between said first and second guided piston assemblies, such that said third and fourth open looped bellows pairs together constitute a second closed loop system, said first and second closed loop systems operating in parallel such that should one closed loop system fail, the remaining closed loop system will serve as a redundant back-up to ensure continued functionality of said actuation system.

8. An actuation system for converting a linear mechanical input motion into a rotary mechanical output motion wherein said mechanical output motion actuates a device, said actuation system comprising:

an input actuator including a first fluid pressurizing means;

an output actuator including a second fluid pressurizing means, a housing, an output actuator shaft extending into said housing, and a guided piston assembly connected to said output actuator shaft;

a flexible fluid line extending between said first and second fluid pressurizing means and providing fluid communication therebetween, said first fluid pressurizing means being responsive to said mechanical input motion to pressurize fluid therein and force said fluid into said fluid line;

said guided piston assembly being arranged to interact with said second fluid pressurizing means in such a manner as to travel linearly in response to the influx of said pressurized fluid into said second fluid pressurizing means from said fluid line;

said output actuator shaft having first and second opposed spiral grooves extending along its length, said guided piston assembly having a drive connection mechanism mounted thereon, said drive connection mechanism having a first portion thereof which fits into said first groove and a second portion thereof which fits into said second groove, such that when said guided piston assembly travels linearly in response to the influx of said pressurized fluid into said second fluid pressurizing means, said drive connection means first and second portions travel along said spiral grooves, thereby rotating said output actuator shaft and initiating a rotary mechanical output motion.

9. The actuation system as recited in claim 8, wherein said first portion comprises a roller which is positioned to roll along one of said spiral grooves, and a guide pin which extends from said guided piston assembly and is attached to said roller, thereby guiding said roller along said one of said grooves.

10. The actuation system as recited in claim 9, and including a restraint means for preventing said guided piston assembly from rotating within said actuator housing, said restraint means comprising at least one groove disposed in said actuator housing and at least one restraint element extending from said guided piston assembly into said groove, thereby ensuring that said piston assembly is free to move linearly within said housing, but is restrained from rotation with respect thereto.

11. The actuation system as recited in claim 8, wherein said input actuator comprises:

a housing:

an input actuator shaft extending into said housing; and an input guided piston assembly connected to said input actuator shaft and arranged to interact with said first fluid pressurizing means, said input actuator shaft being adapted to move in response to said mechanical input motion, and said guided piston assembly being adapted to travel linearly in response to motion of said shaft, wherein the linear travel of said guided piston assembly actuates the first fluid pressurizing means to pressurize the fluid therein, such that the pressurized fluid is forced through the fluid line into said second fluid pressurizing means.

* * * * *